US006196410B1

(12) United States Patent
Hocking

(10) Patent No.: US 6,196,410 B1
(45) Date of Patent: Mar. 6, 2001

(54) PAINT TRAY LINER WITH COVER

(75) Inventor: Homer Douglas Hocking, Lake Arrowhead, CA (US)

(73) Assignee: Contract Commercial Products, Upland, CA (US)

( * ) Notice: Subject to any disclaimer, the term of this patent is extended or adjusted under 35 U.S.C. 154(b) by 0 days.

(21) Appl. No.: 09/268,962

(22) Filed: Mar. 16, 1999

(51) Int. Cl.[7] ..... B65D 25/16

(52) U.S. Cl. ..... 220/495.02; 206/209; 206/362; 220/839

(58) Field of Search ..... 206/209, 205, 206/1.8, 1.9, 361, 362, 362.1, 362.2, 362.3, 15.2, 15.3, 229; 220/570, 837, 839, 495.01, 495.02, 495.06; 15/257.05, 257.06

(56) References Cited

U.S. PATENT DOCUMENTS

| | | | | |
|---|---|---|---|---|
| 2,887,705 | | 5/1959 | Serwer . | |
| 3,514,012 | | 5/1970 | Martin . | |
| 3,625,388 | * | 12/1971 | Golden | 220/570 |
| 3,828,389 | | 8/1974 | Heisler . | |
| 3,850,298 | | 11/1974 | Jolly . | |
| 4,445,250 | | 5/1984 | Seidl . | |
| 4,541,542 | | 9/1985 | Florentino . | |
| 4,547,926 | | 10/1985 | Kern . | |
| 4,651,379 | | 3/1987 | Kern . | |
| 4,802,576 | * | 2/1989 | Kern | 206/361 |
| 5,460,289 | * | 10/1995 | Gemmell | 220/495.02 |
| 5,533,228 | * | 7/1996 | Jarecki et al. | 15/257.06 |
| 5,553,701 | | 9/1996 | Jarecki et al. . | |
| 5,645,164 | | 7/1997 | Hocking . | |
| 5,645,167 | * | 7/1997 | Conrad | 206/361 |
| 5,960,946 | * | 10/1999 | Gramlich | 206/15.3 |
| 5,966,772 | * | 10/1999 | Woodnorth et al. | 220/495.02 |

* cited by examiner

*Primary Examiner*—Luan K. Bui
(74) *Attorney, Agent, or Firm*—Sheldon & Mak; Denton L. Anderson

(57) ABSTRACT

This invention is a closeable paint tray liner with cover, where the paint tray liner body may securely fit into a paint roller tray. The paint tray liner body is also designed to accommodate paint tools, such as a paint brush and a paint roller with handle, within said liner body, when the paint tray liner with cover is in the closed position, and with the paint tray liner cover positioned over the paint tray liner body. Said paint tray liner with cover is also designed to accommodate said paint tools, on the sloped roll-out platform and out of the paint well, with the handle of each tool protruding from orifices in the front of the paint tray liner with cover. A preferred embodiment of the paint tray liner with cover is composed essentially of a polymeric material, such as PETE.

19 Claims, 23 Drawing Sheets

PAINT TRAY LINER WITH COVER

FIELD OF THE INVENTION

This invention relates generally to painting equipment and, more specifically, to paint retaining containers.

BACKGROUND OF TIE INVENTION

Paint retainer containers have always been necessary to retain a quantity of paint for the ready access of the person doing the painting.

A fundamental problem with respect to all paint retaining containers is that they are generally open to the atmosphere. This allows a significant quantity of volatile hydrocarbon materials within the paint to evaporate into the atmosphere. This is a problem for the painter in that it tends to dry out the paint. It is also a problem for the atmosphere because the evaporated hydrocarbons tend to pollute the air.

Numerous attempts have been made to produce a practical paint retaining container which minimizes the exposure of the paint to the atmosphere. None of these attempts, however, have been wholly successful.

Accordingly, there is a need for a paint retaining container which is simple and inexpensive to manufacture and distribute, while at the same time, being practical and efficient for the user.

SUMMARY

The invention satisfies this need. The invention is a paint tray liner comprising (a) a liner body having a forward end, a rearward end, a bottom wall and side walls, the bottom wall of said liner body being a sloped platform having a raised portion at the forward end of the liner body, and depressed paint well portion at the rearward end of the liner body, the side walls defining a perimeter around the paint tray liner; (b) an outer liner flange located around the perimeter of the liner body; and (c) a cover connector attached to the paint tray liner for connecting a paint tray cover to the paint tray liner. The paint tray liner is typically used in combination with a paint tray cover.

The present paint tray liner may be a one-piece construction or a two-piece construction, depending upon whether the cover is removable, or is attached or affixed to the tray. The paint tray liner invention may accommodate a standard size paint brush, paint roller, or other painting tools, and the cover of the paint tray liner may be closed by the user with the brush, roller, and other tools within said liner. The paint tray liner invention may accommodate standard size painting tools out of the paint tray liner's paint well with the paint tray liner's cover in the closed position.

A primary application of this invention is to offer the manufacturer a paint tray liner which is lightweight, yet strong, and inexpensive to manufacture, stackable when stockpiled in the open position.

Another primary application of this invention is to offer the user a paint tray liner which is inexpensive and therefore disposable, and which may have an attached or unattached liner cover, and that said cover may also close over the liner body, when painting tools are housed within the liner body.

The invention is related to applicant's U.S. Pat. No. 5,645,164, the entirety of which is incorporated herein by this reference.

DRAWINGS

These features, aspects and advantages of the present invention will become better understood with regard to the following description, appended claims and accompanying figures where:

Figure 4:
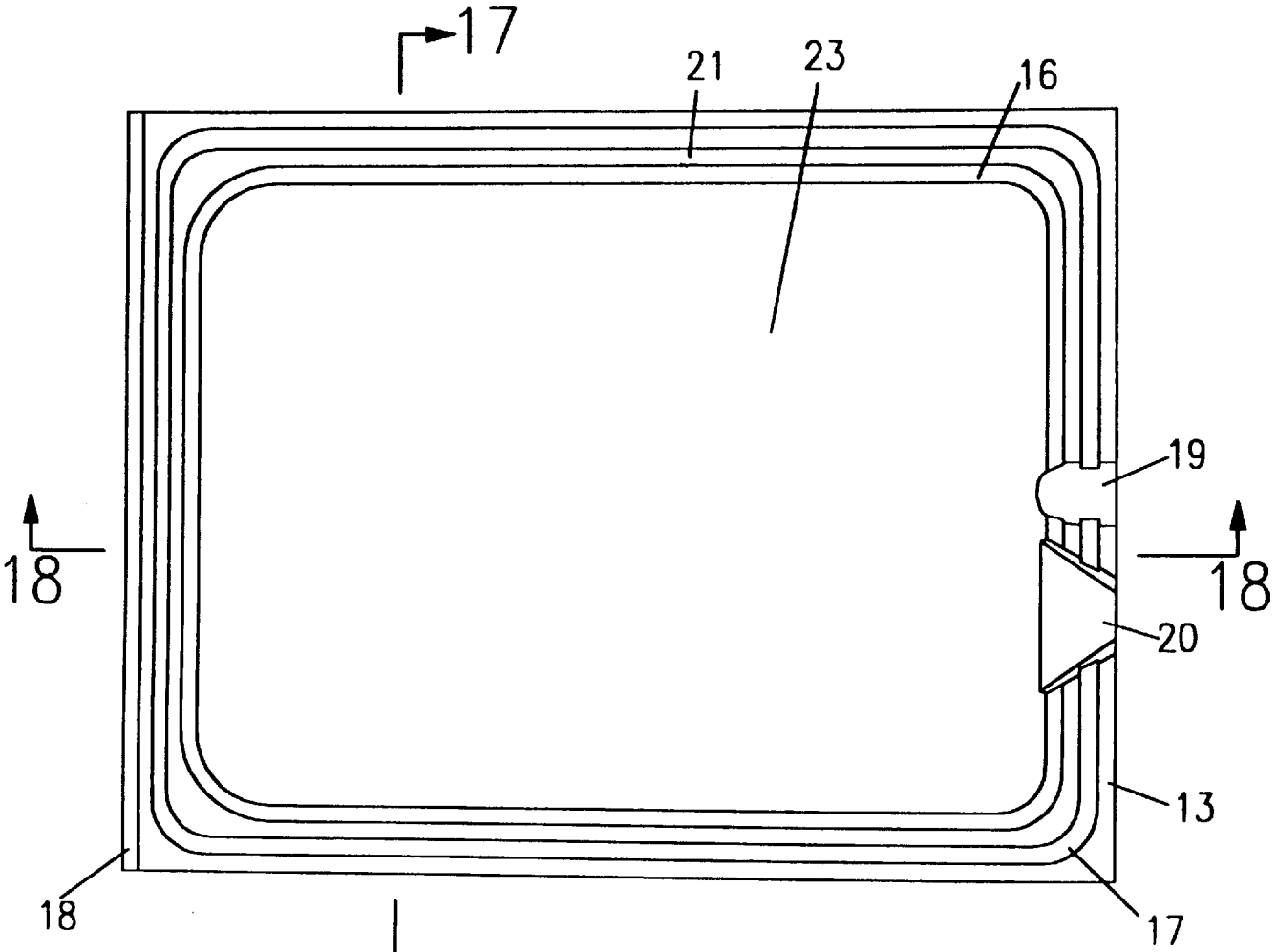
FIG. 4 shows a top view of an embodiment of the paint tray liner with attached cover, in the closed position.
Figure 5:
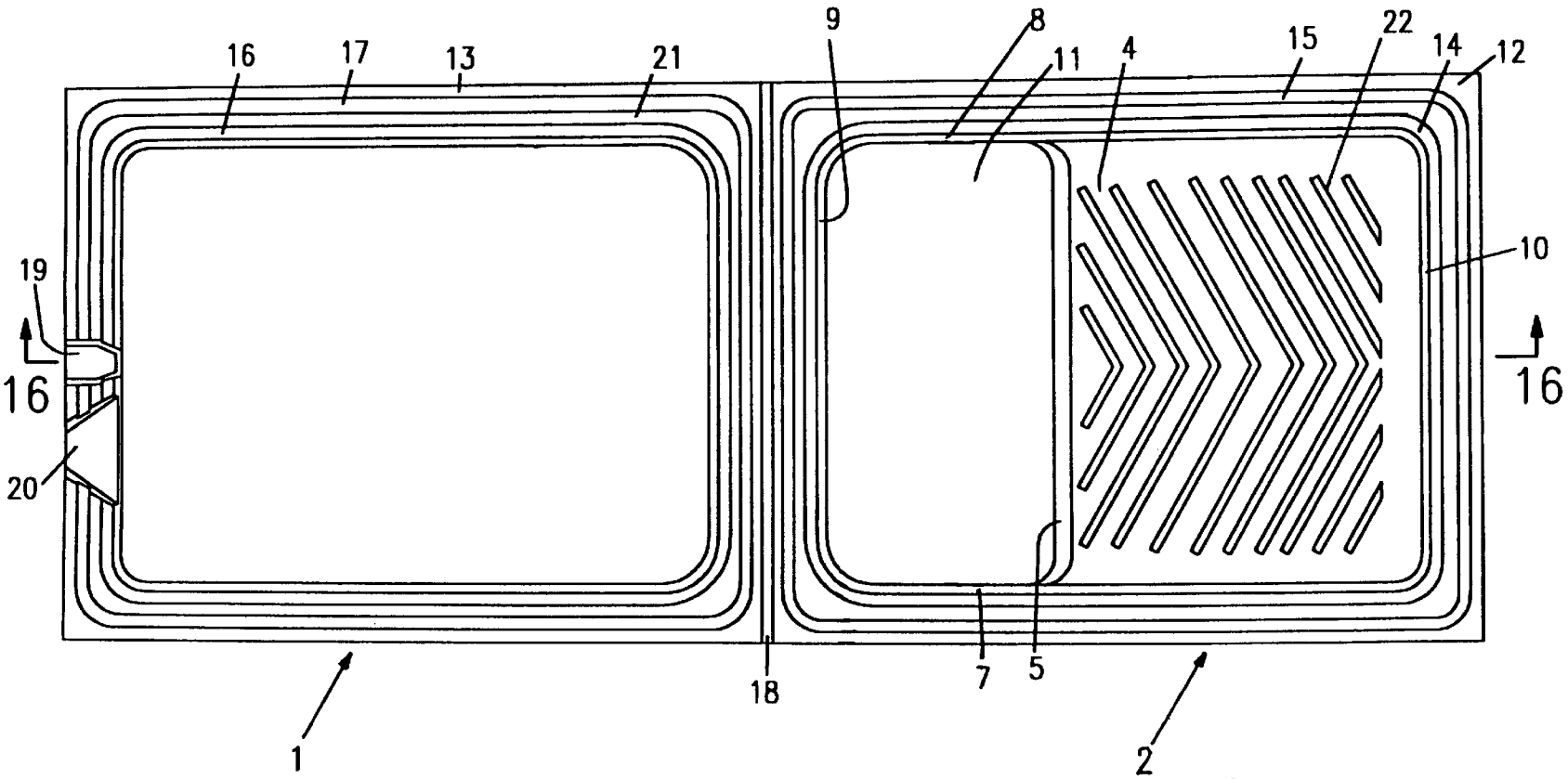
FIG. 5 shows a top view of an embodiment of the paint tray liner with attached cover, in an open position.
Figure 6:
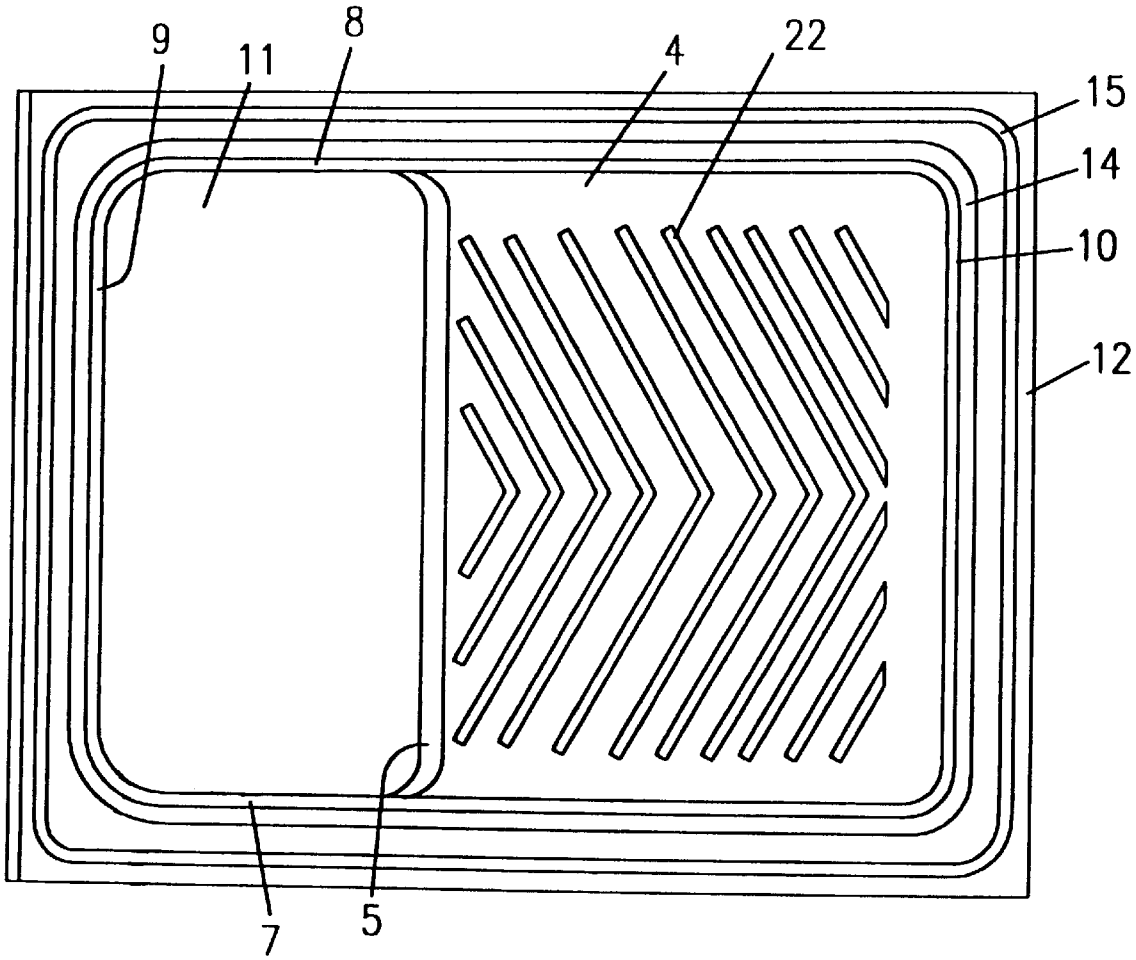
FIG. 6 shows a bottom view of an embodiment of the paint tray liner with attached cover, in the closed position.
Figure 7:
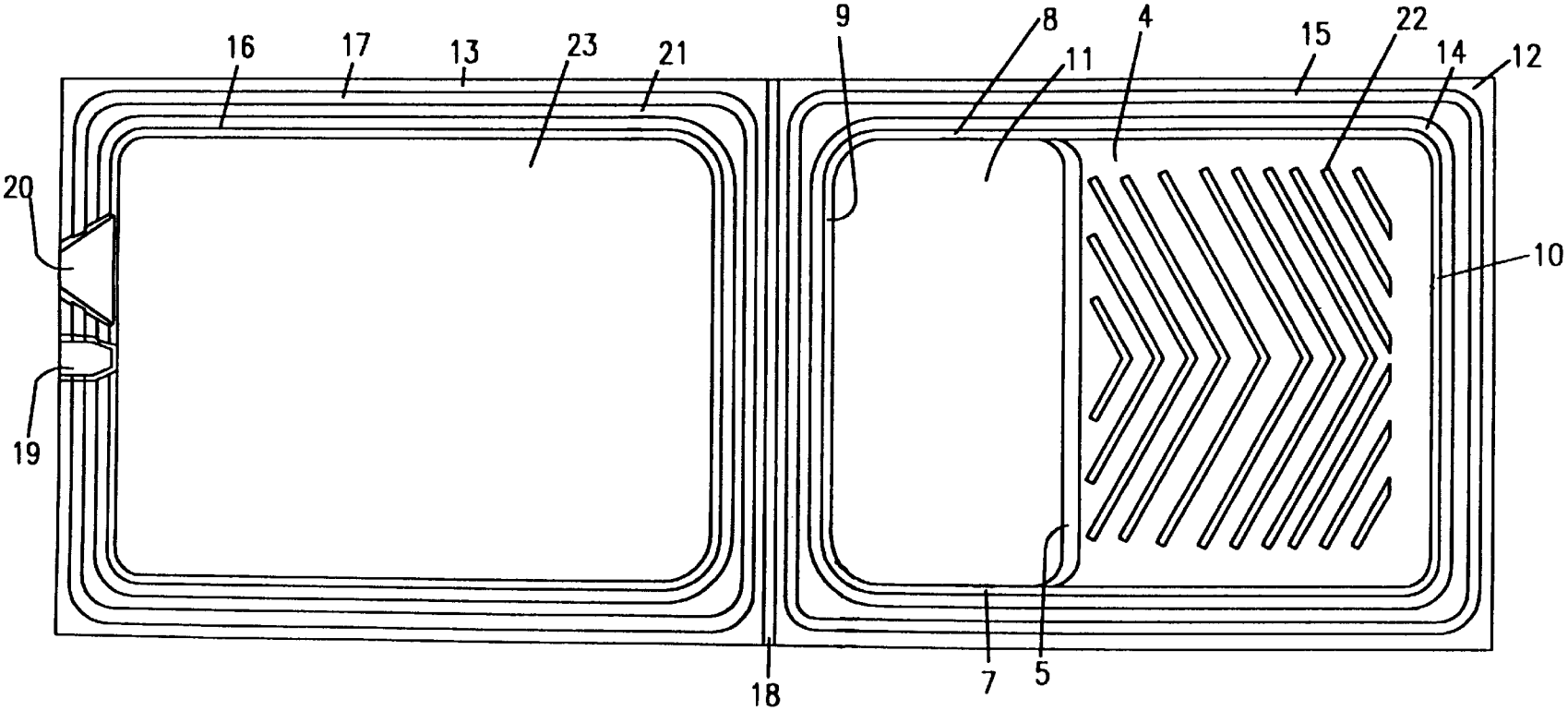
FIG. 7 shows a bottom view of an embodiment of the paint tray liner with attached cover, in an open position.
Figure 8:
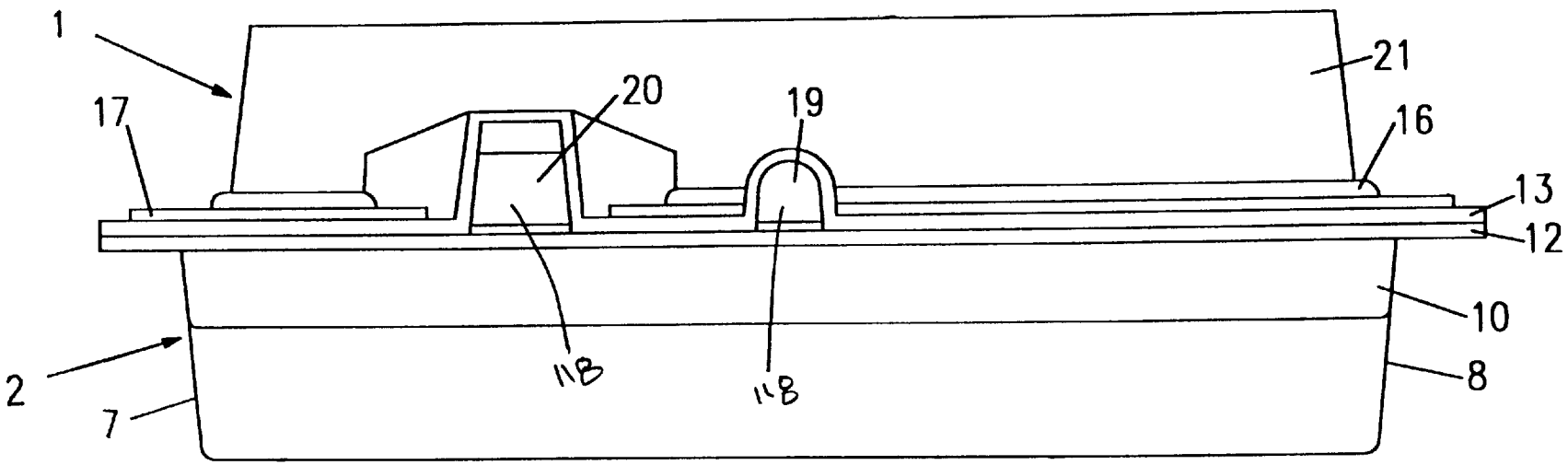
FIG. 8 shows a front view of an embodiment of the paint tray liner, with attached cover, in the closed position.
Figure 9:
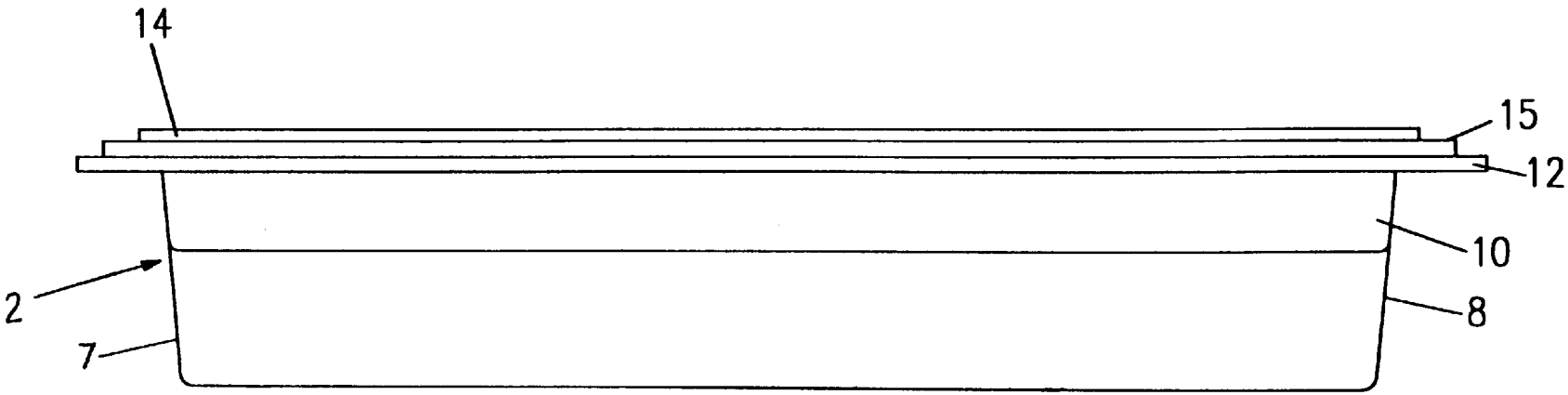
FIG. 9 shows a front view of an embodiment of the paint tray liner, with attached cover, in an open position.
Figure 10:
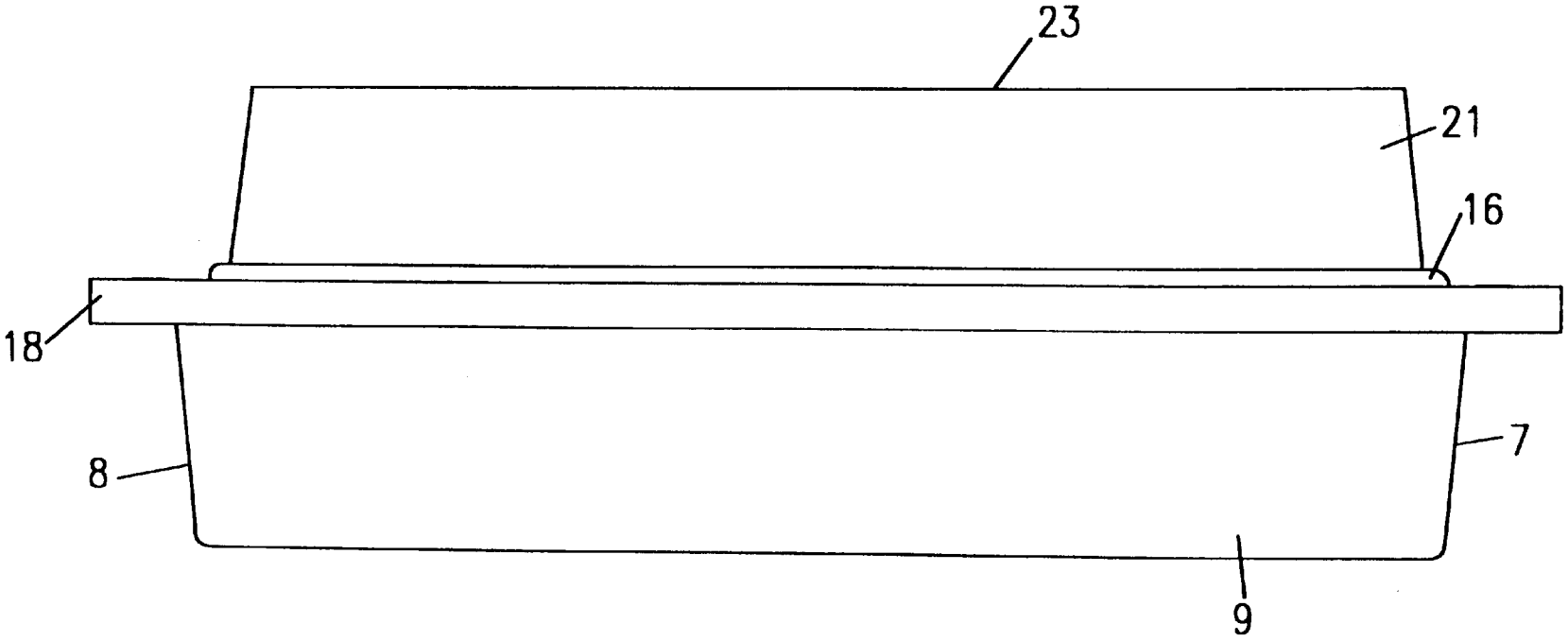
FIG. 10 shows a rear view of an embodiment of the paint tray liner, with attached cover, in the closed position.
Figure 11:
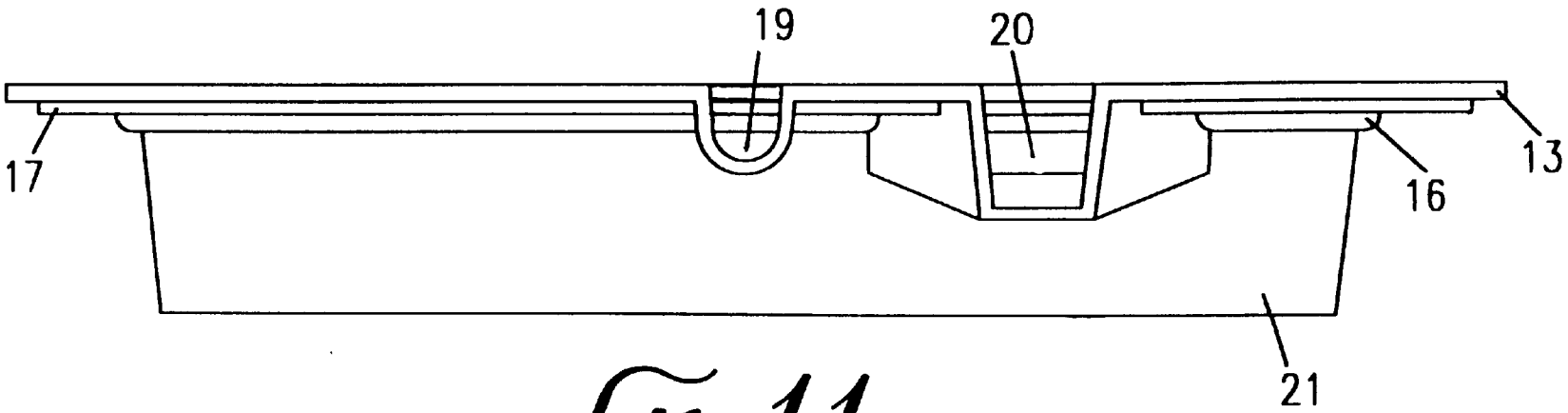
FIG. 11 shows a front view of an embodiment of the paint tray liner, with attached cover, in an open position.
Figure 12:
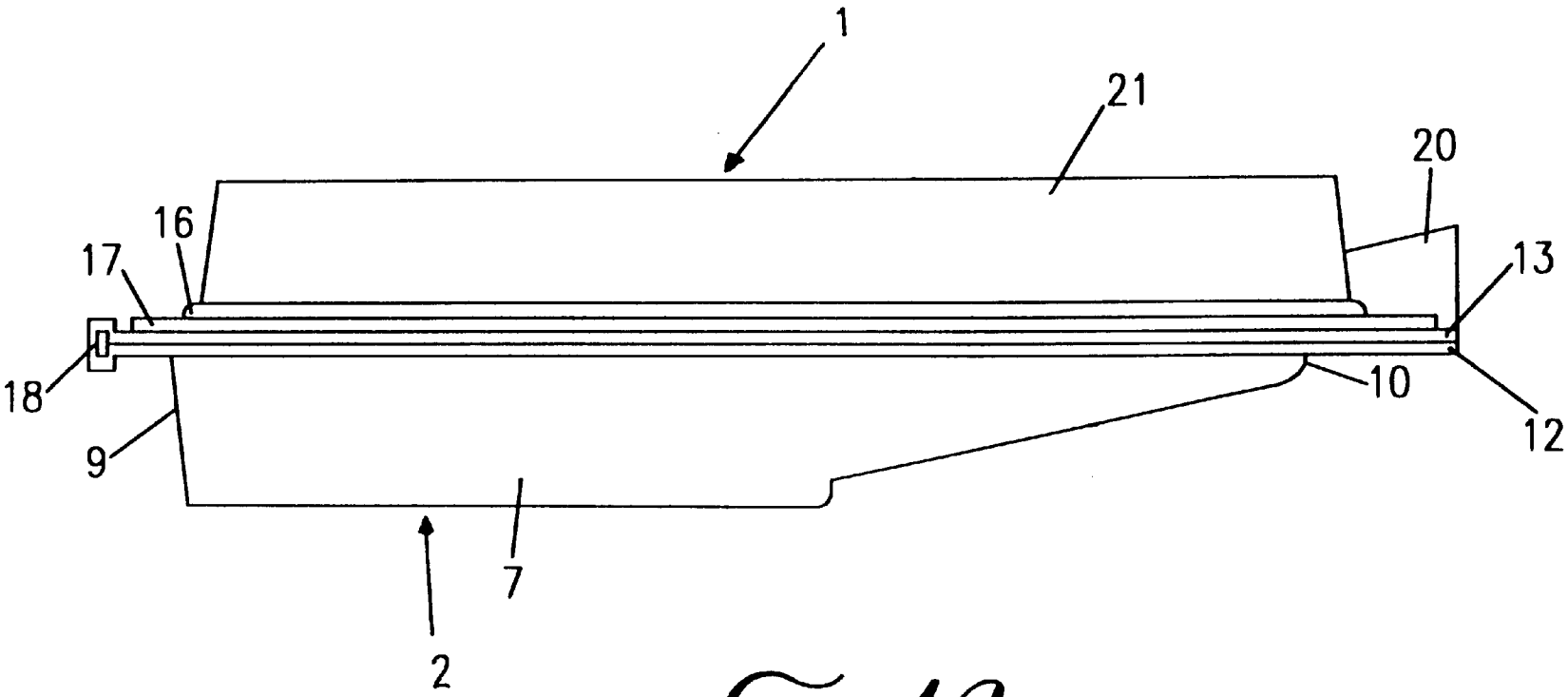
FIG. 12 shows a side view of an embodiment of the paint tray liner, with attached cover, in the closed position.
Figure 13:
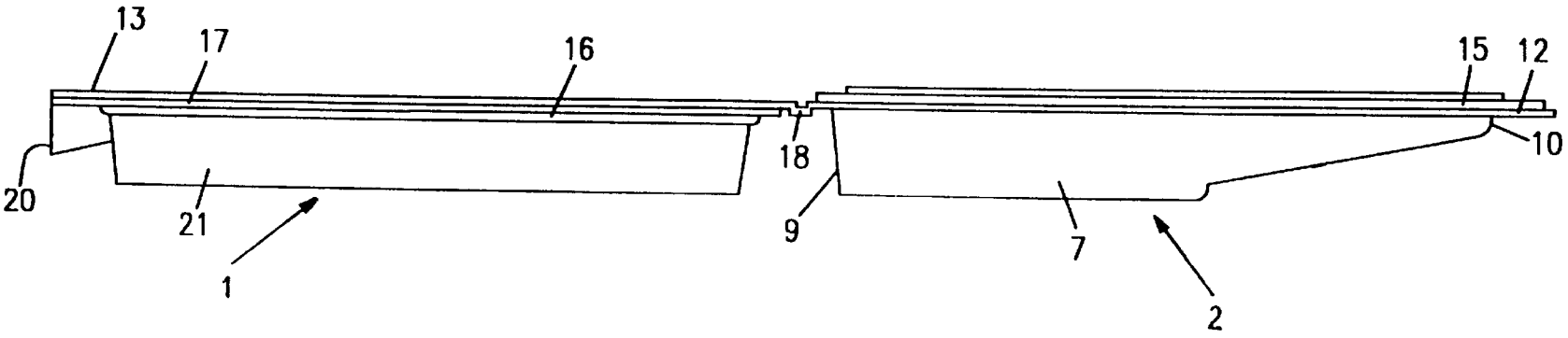
FIG. 13 shows a side view of an embodiment of the paint tray liner, with attached cover, in an open position.
Figure 14:
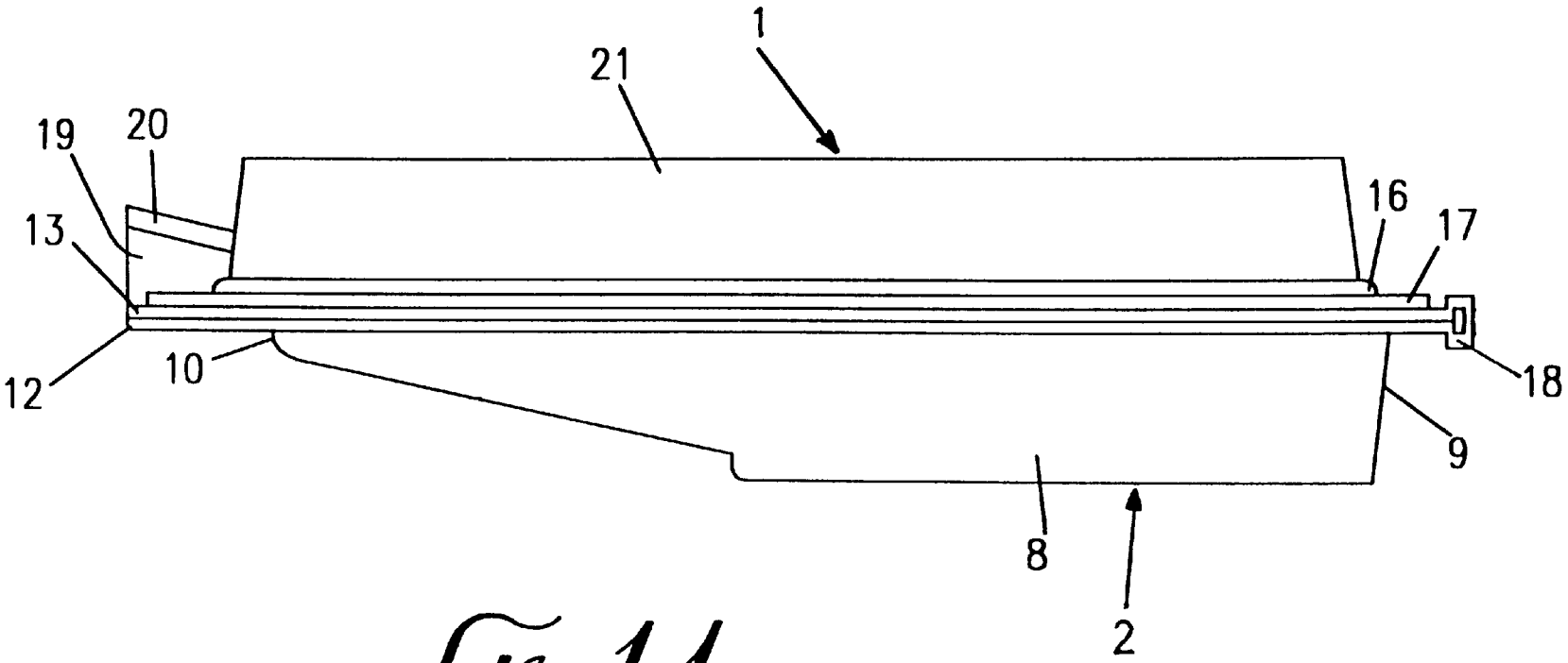
FIG. 14 shows a side view of an embodiment of the paint tray liner, with attached cover, in the closed position.
Figure 15:
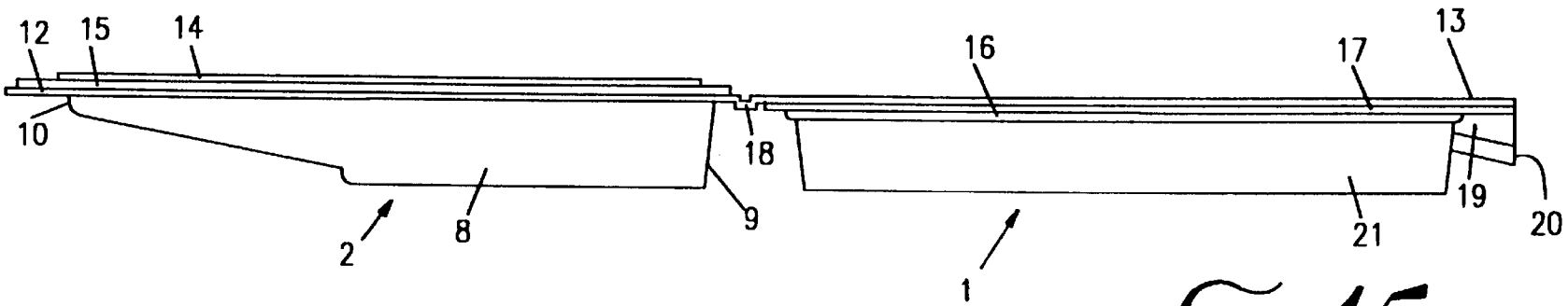
FIG. 15 shows a side view of an embodiment of the paint tray liner, with attached cover, in an open position.
Figure 16:
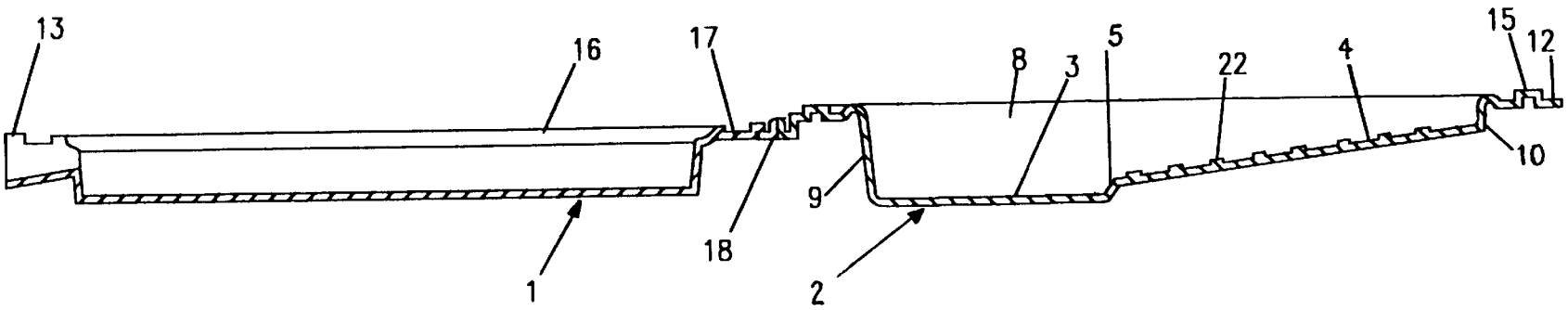
FIG. 16 shows a sectional side view along the length of an embodiment of the paint tray liner with attached cover, in an open position, whereby said section is made along lines 16—16 of FIG. 5.
Figure 17:
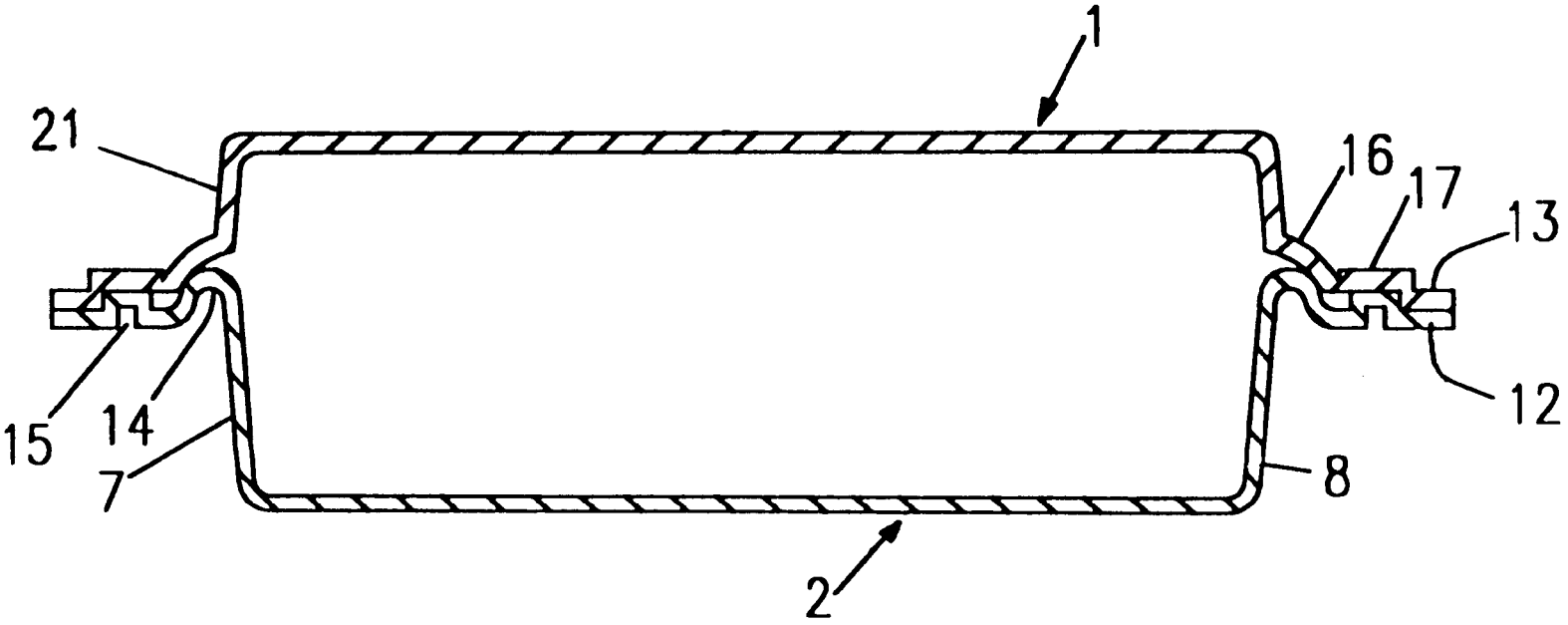
FIG. 17 shows a sectional side view along the width of an embodiment of the paint tray liner with attached cover, in the closed position, whereby said section is made along lines 17—17 of FIG. 4.
Figure 18:
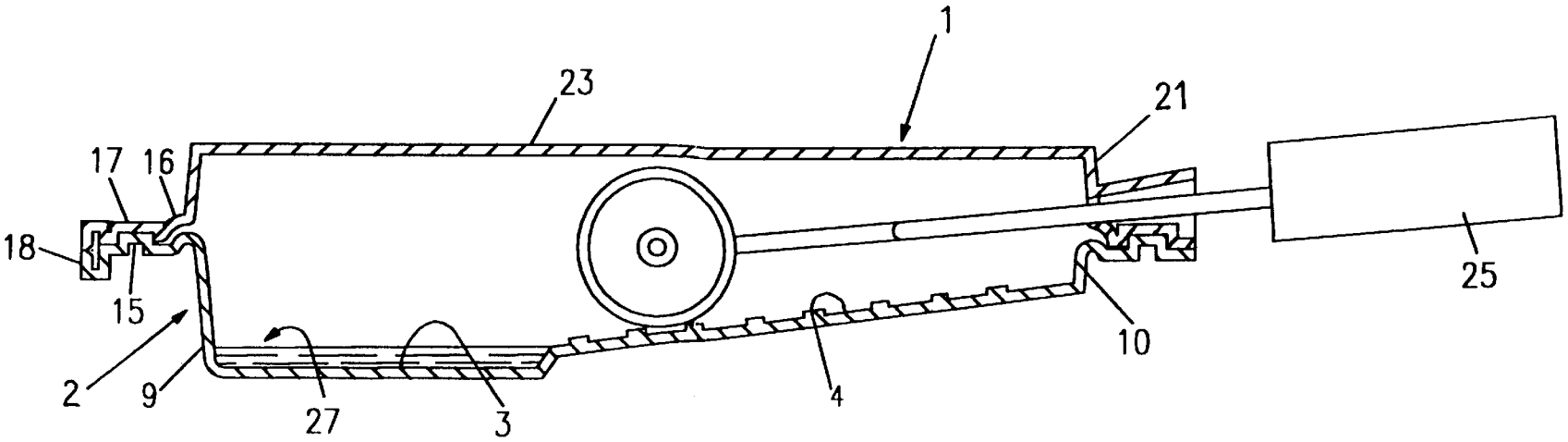
FIG. 18 shows a sectional side view along the length of an embodiment of the paint tray liner with attached cover, in the closed position, whereby said section is made along lines 18—18 of FIG. 4, and with a paint roller with handle in the storage position within said paint tray liner, and showing some paint within the paint well.
Figure 19:
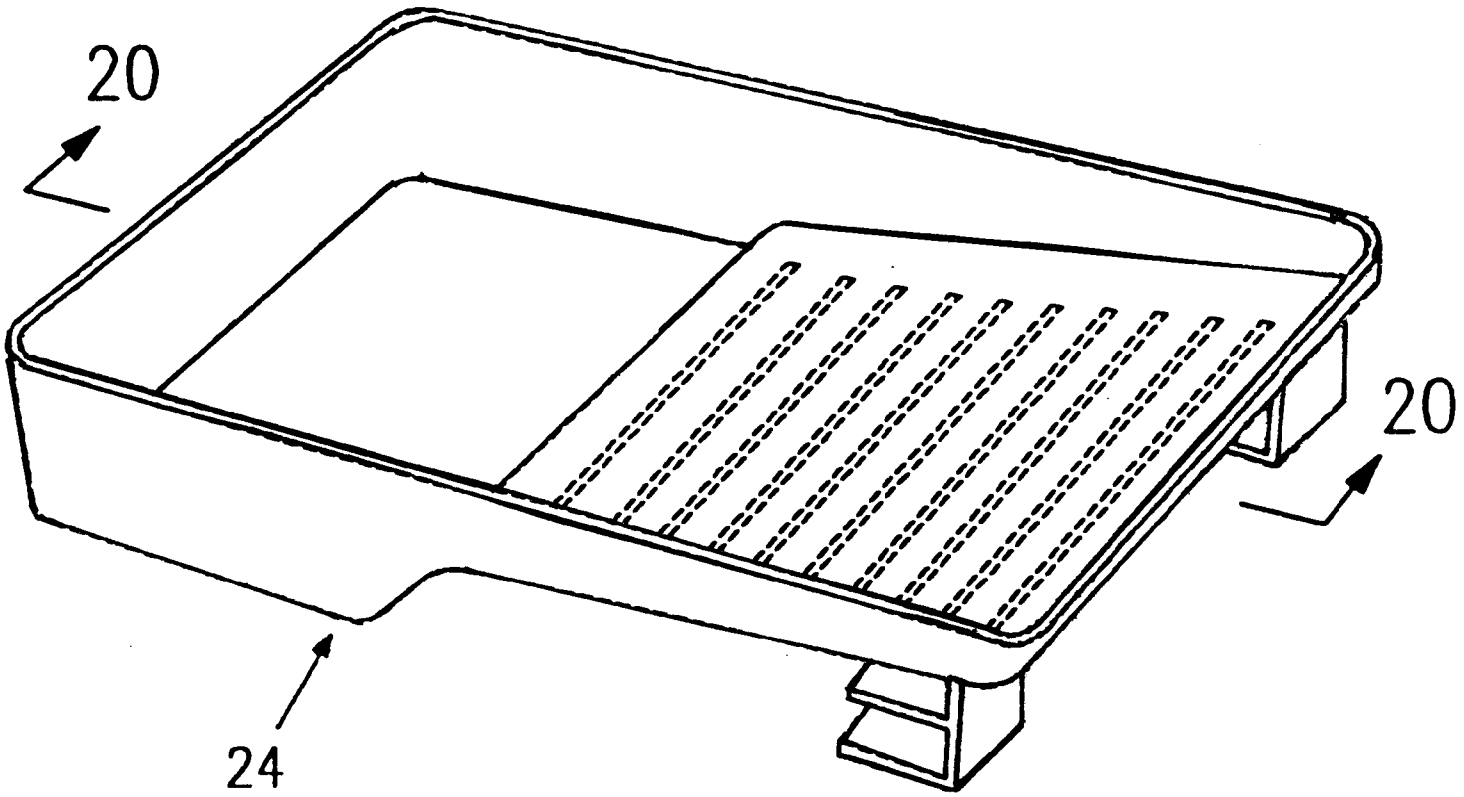
FIG. 19 shows an isometric side view a paint tray useable in the invention, which is intended to hold or retain the present paint tray liner invention.
Figure 20:
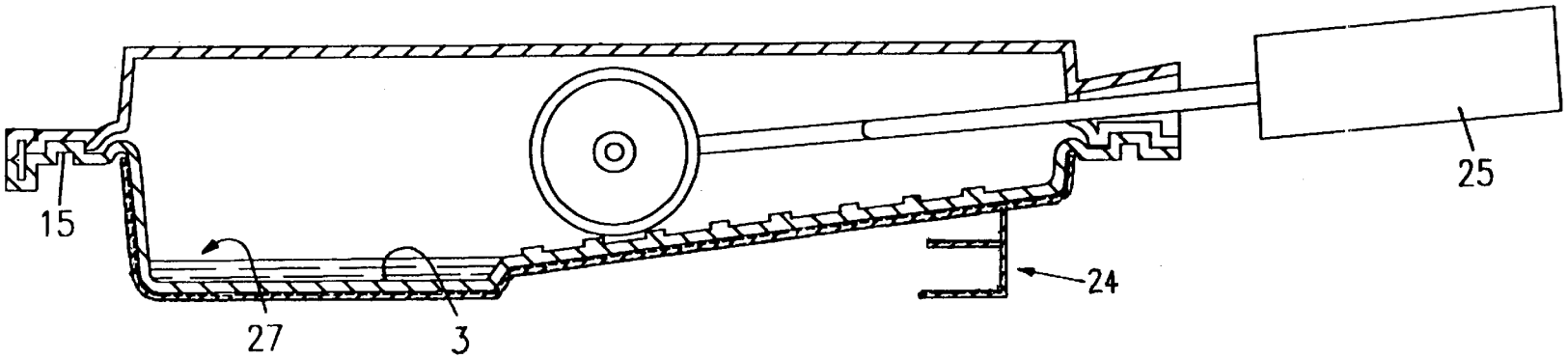
Figure 21:
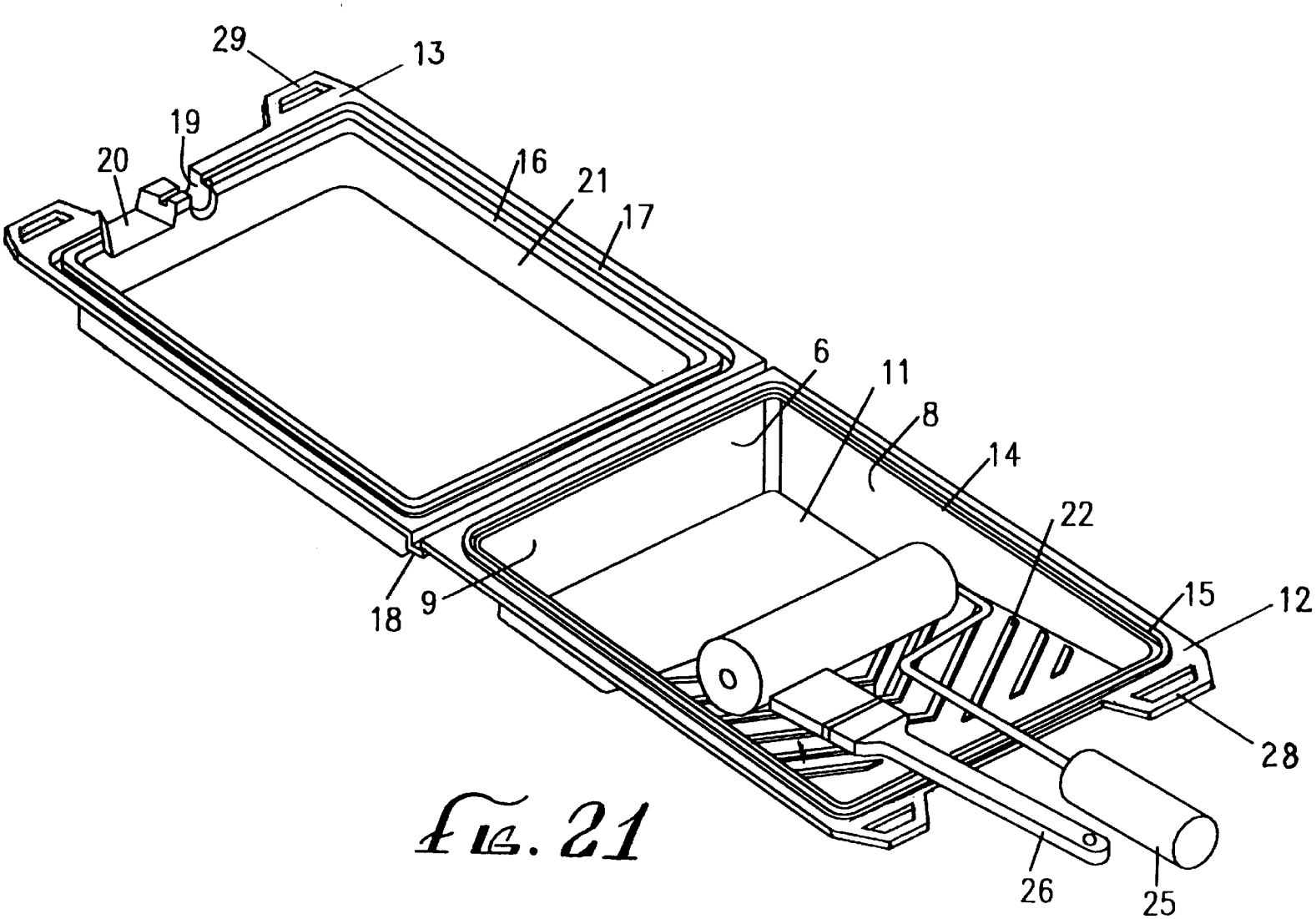
Figure 22:
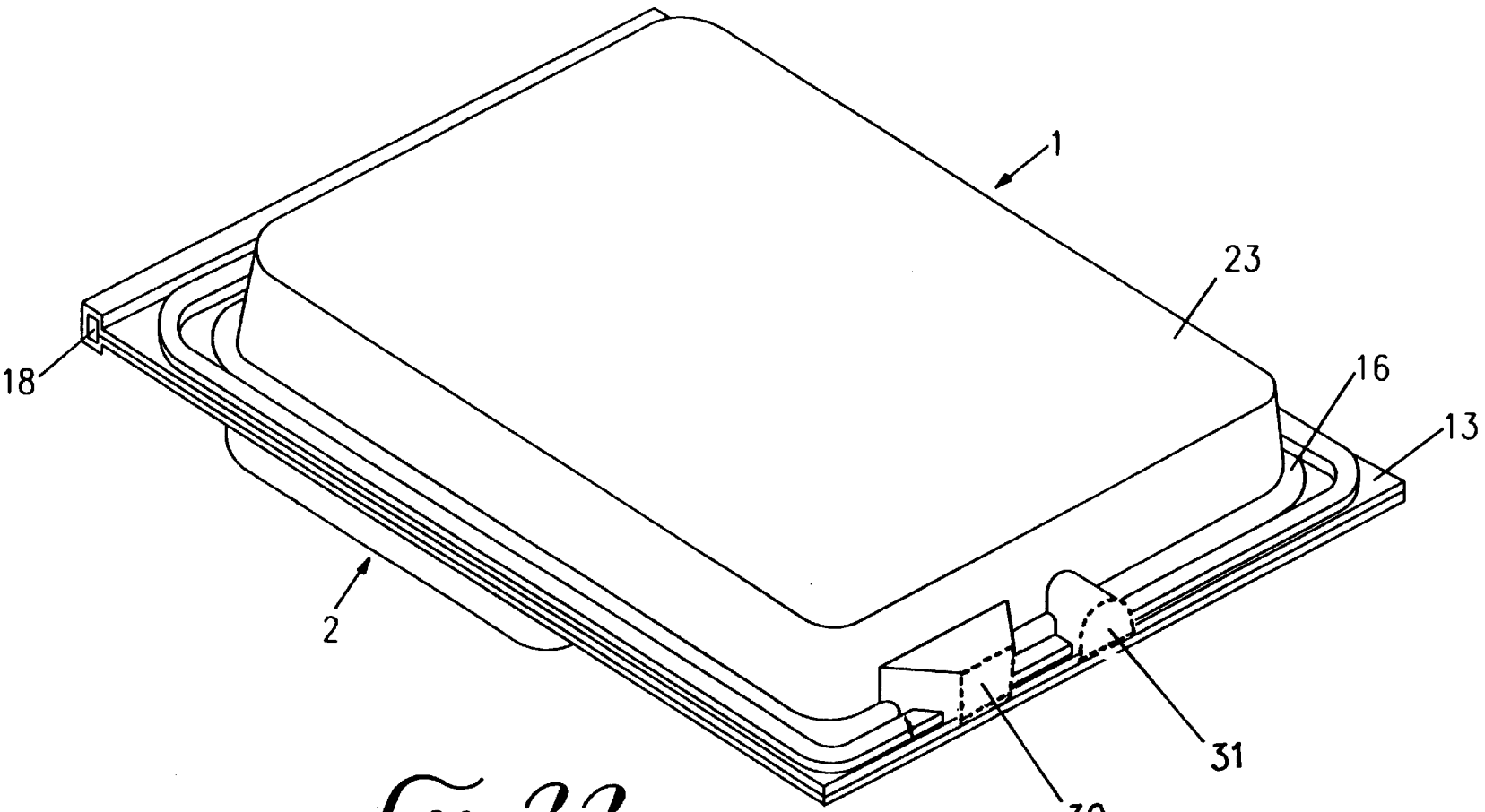
Figure 23:
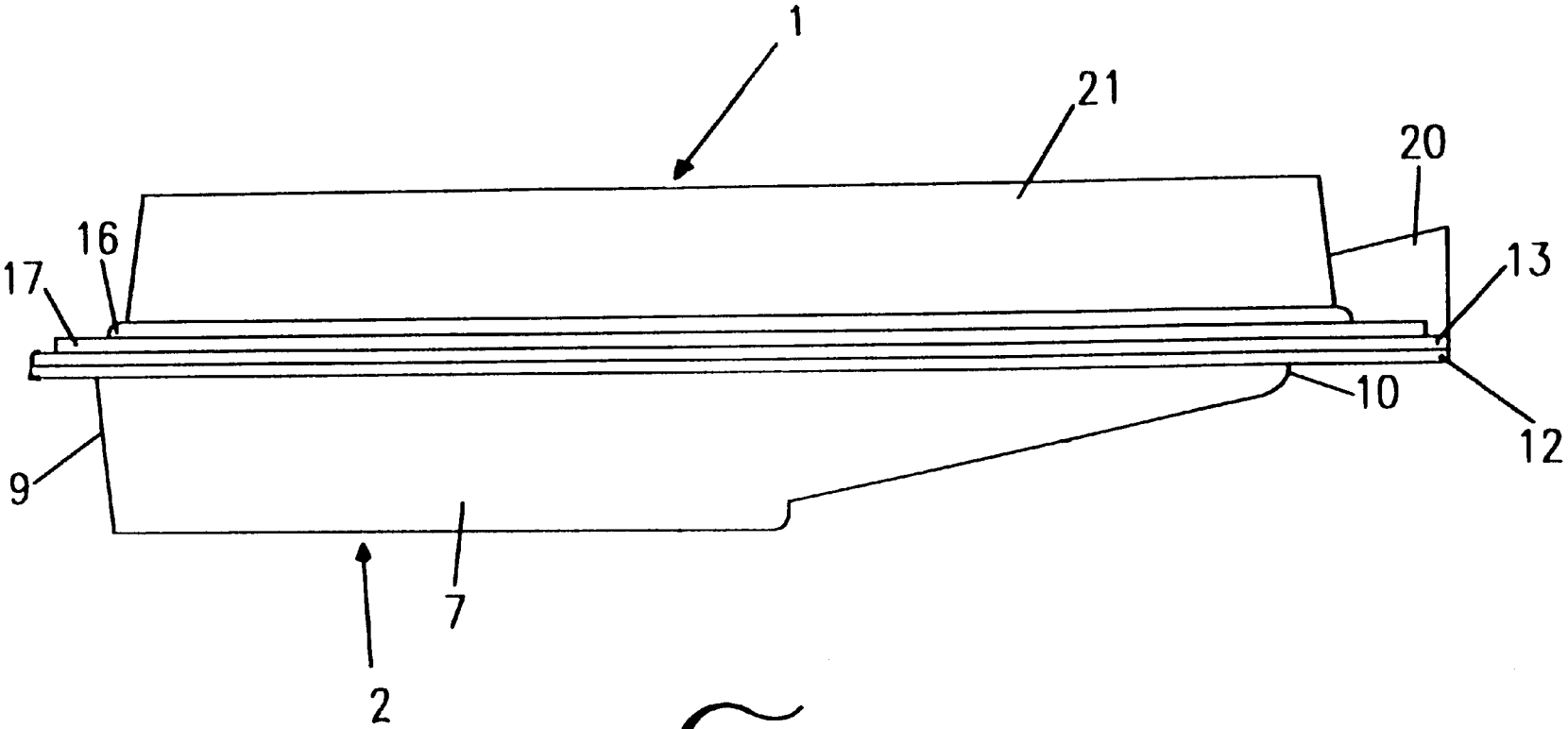

FIG. 20 shows a sectional side view of a combination having features of the invention wherein the paint tray liner with is shown attached cover, in the closed position, whereby the section for the paint tray is made along lines 20—20 of FIG. 19, and the section for the paint tray liner is made along lines 18—18 of FIG. 4, with a paint roller with handle in the storage position within said paint tray liner, and showing some paint within the paint well;

FIG. 21 shows a front isometric top view of an embodiment of the paint tray liner with attached cover in an open position, and further showing two optional liner body tabs and two liner cover tabs, as well as a paint brush and a paint roller with handle, in the storage position, in said liner;

FIG. 22 shows a front isometric top view of a paint tray liner with attached cover in a closed position and with searations for affecting openings in said cover; and FIG. 23 shows a side view of an embodiment of the paint tray liner, with an unattached cover in the closed position.

DESCRIPTION OF THE PRESENT INVENTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a combination of a paint tray liner 100 nested within a paint tray 24.

The paint tray liner 100 comprises a liner body 2, an outer liner flange 12 and a cover connector 102. The liner body 2 has a forward end 104, a rearward end 106, a bottom wall 108 and side walls 110. The liner body 2 is typically of a generally rectangular shape. In such embodiment, the side walls 110 comprise a front side wall 10 back wall 9, a left side wall 8 and a right side wall 7. The side walls 110 define a perimeter 112 which extends around the upper outside portion of the liner body 2.

The bottom wall 108 is a sloped platform 4 having a raised portion 5 at the forward end 104 of the liner body 2 and a depressed portion 3 at the rearward end 106 of the liner body 2.

The outer liner flange 12 is located around the perimeter 112 of the liner body 2.

The cover connector 102 can be any of the large number of cover connectors 102 known in the art capable of connecting a cover 1 to the liner body 2 in such a way that the cover 1 essentially encloses the liner body 2. As illustrated in the drawings, the cover connector 102 can be a hinge 18 disposed, for example, at the rearward end 106 of the liner body 2. Alternatively, the cover connector 102 can be a raised tongue portion or a depressed groove portion on the outer liner flange 12, sized and dimensioned to mate with a corresponding cover liner flange 13 in the cover 1. An example of such tongue and groove connectors is illustrated in the drawings as body alignment tang 15 and cover alignment tang 17. Where the alignment tang 15 or other tongue or groove cover connector is used, it is preferable that the respective connections press fit together, most preferably snap together, to provide a secure connection.

Paint tray liners 100 of the invention are typically manufactured in three sizes: commercial size, residential size, and mini size. The present paint tray liner 100 invention may be manufactured in any size, including the above-mentioned three sizes. In a primary embodiment, the paint tray liner 100 is intended for use with a standard sized, commercial paint tray 24, and may, as indicated above, house painting tools within the liner, and when the liner is in either the opened or closed positions.

The paint tray liner 100 is typically manufactured by a molding process, and preferably by thermal formed molding process. The paint tray liner is composed essentially of a polymeric material, which is durable, chemically compatible with commercial paint, and strong enough to house a full paint well. Such polymeric materials include PETE, and material olefins, such as polyethylene, polypropylene, and clarified polypropylene if the paint tray liner 100 is to also display products contained therein, such as a paint brush, paint roller with handle and the like.

In some embodiments, a suitable colorant may be added to the polymeric formulation, to add the desired coloration to the paint tray liner 100. In some preferred embodiments of the paint tray liner 100, graphite particles or fibers may be added to the polymeric formulation, such as PETE, in order to achieve a non-stick quality to the paint tray liner 100, if the paint 27 should dry; in which case, the hardened paint could be knocked out of said liner 100. A preferred embodiment of this embodiment of the paint tray liner would have a black, green or clear coloration, because other colorations are more likely to interfere with the user's judgment in mixing paints 27 and achieving the desired color or shade.

In the embodiments illustrated in FIGS. 1–21, the paint tray liner 100 has an attached cover 1 attached to the liner body 2 at a hinge 18 which is located at the rearward end 106 of the liner body 2. The cover has side walls 21 and a top wall 23. In the embodiments illustrated in FIG. 23, the paint tray liner 100 has an unattached cover 1. The unattached cover 1 matedly fits onto the liner body 2, with a cover alignment tang 17 matedly fitting with a liner body alignment tang 15. In a preferred embodiment of the paint tray liner 100 with an unattached cover 1, the cover 1 is sized and dimensioned to nest beneath the paint tray liner 100. This allows the user of such an embodiment to remove the cover 1 from the paint tray liner 100 and conveniently store the cover 1 directly beneath the paint tray liner 100.

In the embodiment illustrated in FIGS. 1–21, the paint tray liner 100 is a molded, one-piece paint tray liner 100 with an attached cover 1, with the molded hinge 18, allowing the liner cover 1 to flip over the liner body 2 in a clam shell manner. The liner body 2 has four sidewalls, i.e., a left sidewall 7, a right sidewall 8, a back sidewall 9 and a front sidewall 10, and each sidewall 110 has two neighboring sidewalls 110. See, e.g., FIGS. 3, 5 and 7. The bottom wall 108, the rearward end 106 of the paint tray liner 100, provide a paint well 11. The bottom wall 108 of the liner body 2 is connected to and attached to one of said four sidewalls 7–10.

The paint well 11 is generally in the rearward end 106 region of the paint tray liner 100. The paint well 11 and the sloped platform 4 are generally, but not necessarily disjoint elements, i.e., they are generally distinct and separate elements. The element at the lower equivalent elevation in the liner body 2 is the bottom of the paint well 11. The sloped platform 4 is sloped down toward the paint well 11. The sloped platform 4 has a platform grid 22 on its top surface. The slope of the platform 4 optimally would conform to the slope of the platform on a standard sized paint tray 24.

Figure 1:
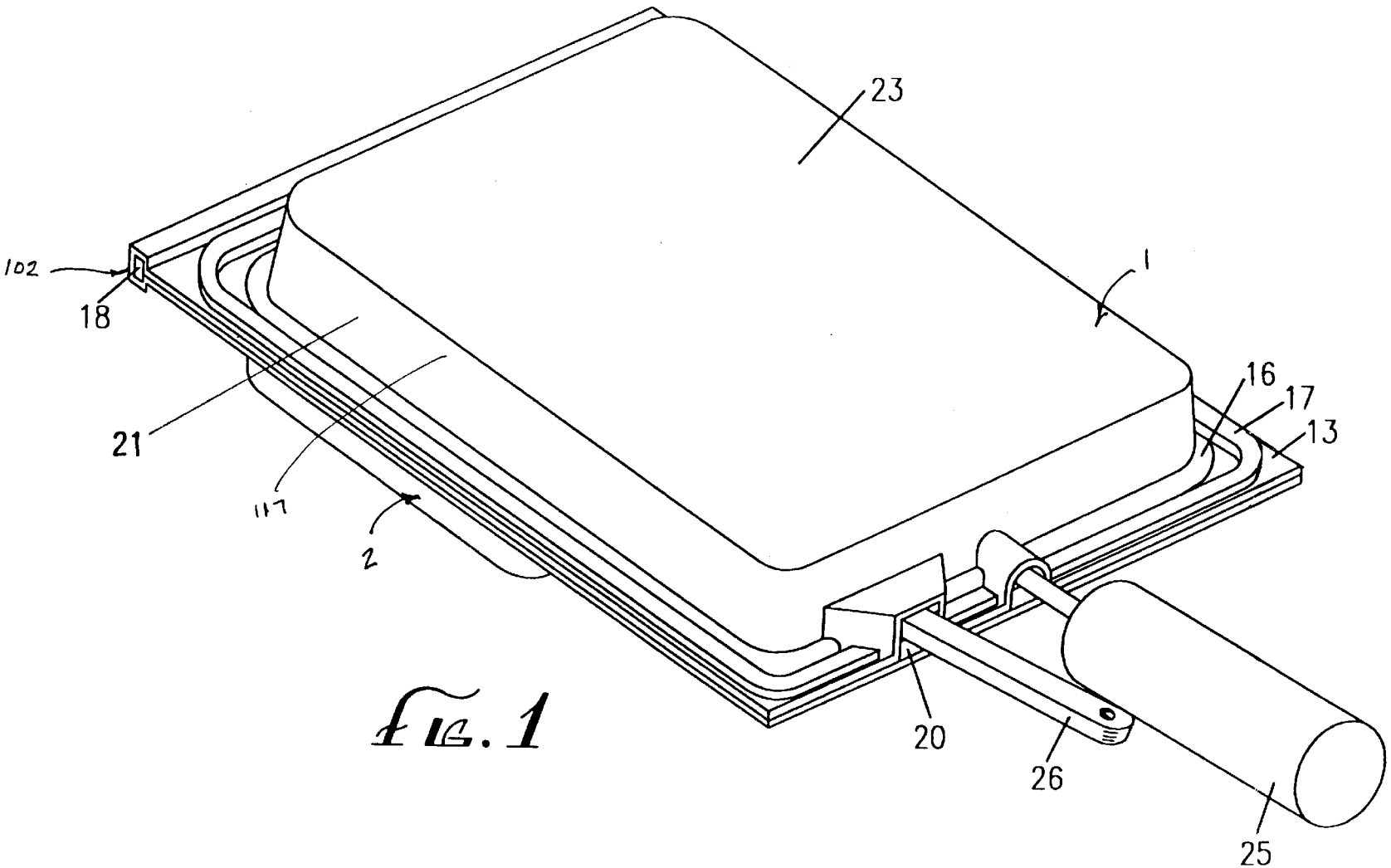
FIG. 1 shows a front isometric top view of an embodiment of the paint tray liner with attached cover, in the closed position, and with a paint brush and a paint roller with handle, in the storage position within said liner, and protruding from the liner.
Figure 2:
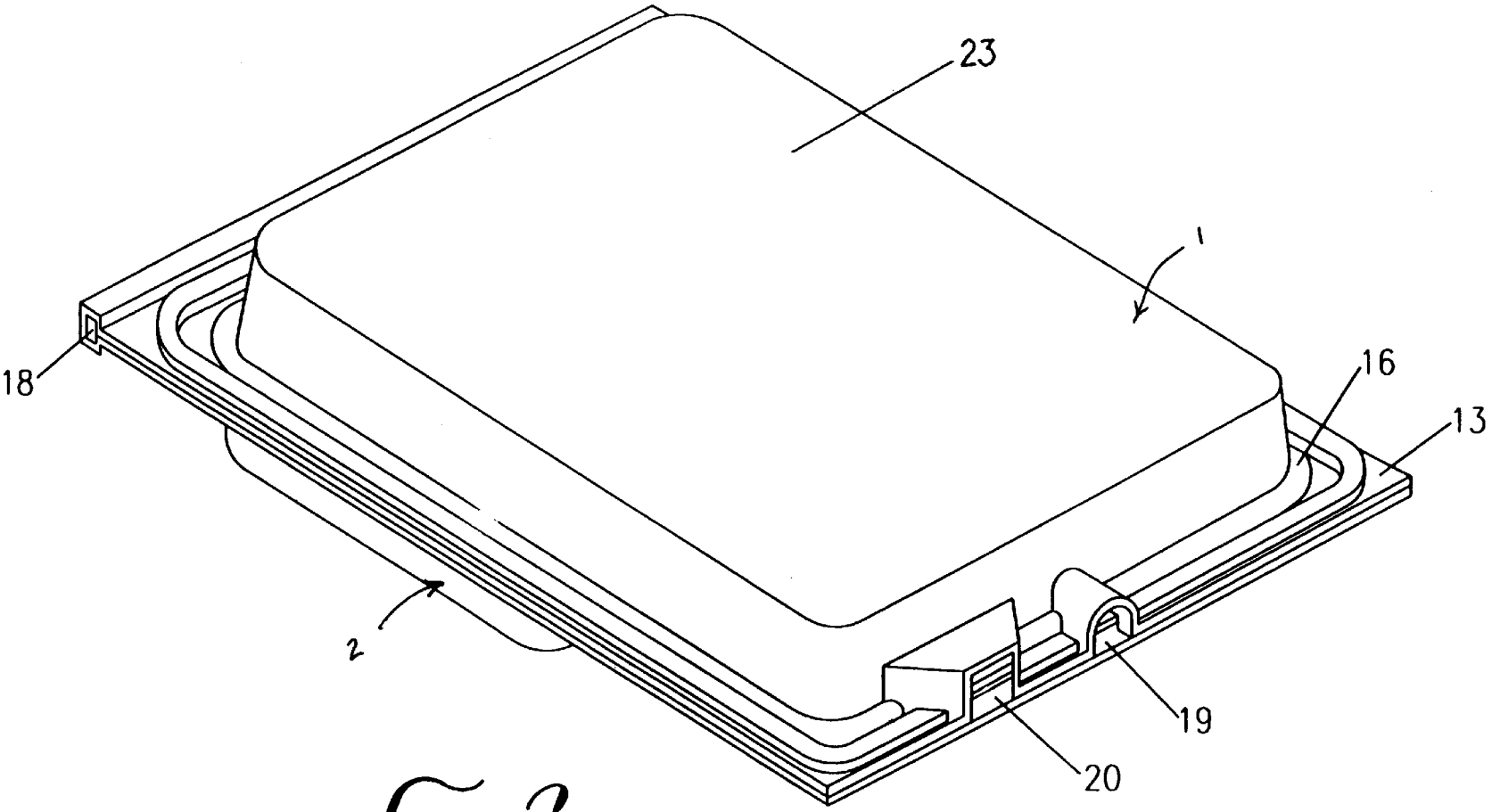
FIG. 2 shows a front isometric top view of an embodiment of the paint tray liner with attached cover, in the closed position.
Figure 3:
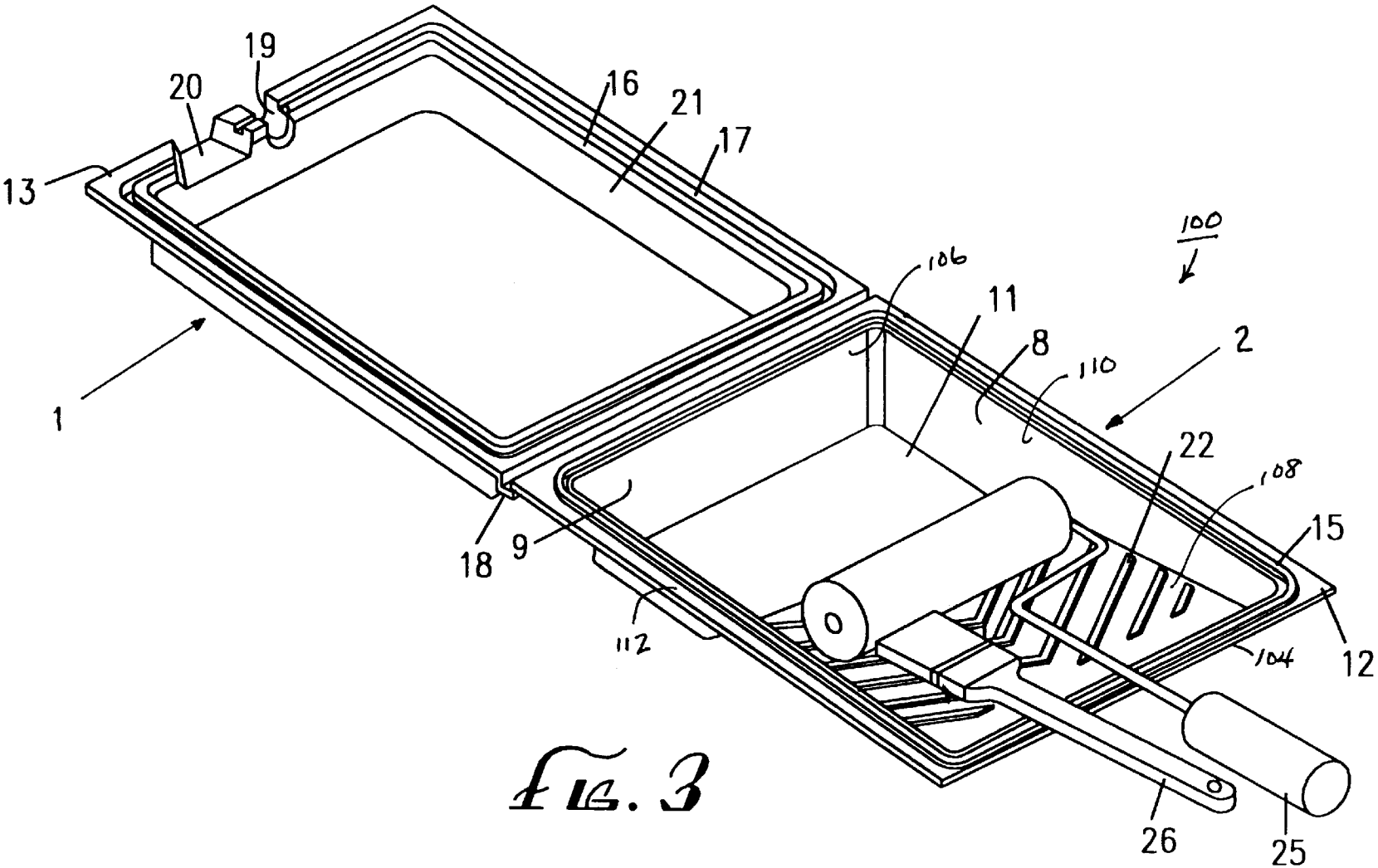
FIG. 3 shows a front isometric top view of an embodiment of the paint tray liner with attached cover, in an open position, and with a paint brush and a paint roller with handle, in the storage position, in said liner.

At the interface between the liner body 2 and the liner cover 1, there is a hinge 18 or the like, allowing the liner cover 1 to flip over the liner body 2, and cover 1 said liner body 2. The hinge 18 also acts as a preliminary alignment device, to align one or more of the various optional mating elements on the liner body 2, with their mates on the liner cover 1. Such optional mating elements include the liner inner radius 14, which matedly fits with the cover inner radius 16, and the liner body alignment tang 15, which matedly fits with the cover alignment tang 17, when the open liner cover 1 is flipped over and onto the liner body 2, thereby taking the paint tray liner 100 with attached cover 1 from the open position (FIG. 3) to the paint tray liner 100 with attached cover 1 in the closed position (FIG. 1). A simple embodiment of the paint tray liner 100 with an attached cover 1 may therefore have three modified embodiments involving said optional mating elements. A first modified embodiment has a liner inner radius 14 mating with the cover inner radius 16. A second modified embodiment has a liner body alignment tang 15 mating with a cover alignment tang 17. A third modified embodiment has both sets of alignment devices from said first and second modified embodiments, i.e., both a liner inner radius 14 and a liner body alignment tang 15, mating with a cover inner radius 16 and a cover alignment tang 17, respectively. FIGS. 3, 5, 18 and 20 show the paint tray liner 100 with an attached cover 1, utilizing this third modified embodiment involving both sets of said alignment devices or means, and this the third modification of the paint tray liner 100 with attached cover 1 is the inventor's preferred embodiment of the paint tray liner, referred to and further described below.

The liner cover 1 has an elevated region 116 protruding from the elevated top 117 of cover 1, which provides more storage capacity for the paint tray liner 100 when displayed commercially, and provides more space for a paint tray roller with handle 25 to fit more easily on the platform 4.

The tray cover 1 has optional mating elements which mate with their respective optional mating elements located on the liner body 2, when the paint tray liner 100 with an attached cover 1 is in the closed position, as described above. The forward portion 104 of the paint tray liner 100 with an attached cover 1, and in the closed position, has one or more openings 118 on the forward end 104 of the cover 1, and said openings 118 may be semicircular, rectangular, or another convenient shape. A preferred embodiment of the paint tray liner 100 has two such openings 118 on the liner cover 1, i.e., the semicircular opening 19 and the rectangular opening 20. The semicircular opening 19 is optionally used to allow a paint roller with handle 25 to be housed within the paint tray liner 100, and outside the paint well 11 and on the sloped platform 4, with the handle of said paint roller 25 protruding from the paint tray liner 100, when said liner is in the closed position, as well as the open position. The rectangular opening 20 is optionally used to allow a paint brush 26 to be housed within the paint tray liner 100, and outside the paint well 11 and on the sloped platform 4, with the handle of said brush 26 protruding from the paint tray liner 100, when said liner 100 is in the closed, as well as the open position.

In alternative embodiments of the paint tray liner 100 with an attached cover 1, the rectangular opening 20 or the semicircular opening 19 may be eliminated from the design, or there may be a plurality of rectangular openings 20 or semicircular openings 19, or a combination thereof. The paint tray liner 100 with an attached cover 1 may therefore have only a singular openings, which may be rectangular or semicircular, or said liner may have a plurality of openings 118, which include one or more rectangular openings 20 or one or more semicircular openings 19, or a combination thereof. The rectangular opening 20 or the semicircular opening 19 may have a semi-elliptical shape or a shape which is in the set of morphisms, mappings, or the like, from a semicircle to a rectangle.

The rectangular opening 20 and the circular opening 19 may be searated or removable, and optionally opened in a tabular or cut-out fashion. In these embodiments, there may be a singular opening 118, which may optionally be elliptical, or there may be a plurality of rectangular or semicircular openings, or a combination thereof. In further variations of this set of modified embodiments, there may not be searations on the cover 1, but said variations may have impressions, thinner regions, tracings or the like, whereby the user of the paint tray liner 100 may cut out an opening on the cover 1, with a scissors, knife or the like.

In a preferred embodiment of the paint tray liner 100 with an attached cover 1, utilizes both alignment devices or means described above. These alignment devices or means are: (1) the mating of the liner inner radius 14 with the cover inner radius 16, and (2) the mating of the liner alignment tang 15 into the cover alignment tang 17, when the open liner cover 1 is flipped over and onto the top of the liner body 2. In this preferred embodiment, the liner alignment tang 15 protrudes to be received by the recessed cover alignment tang 17, as shown in FIGS. 3, 5, 18 and 20.

A complete set of views of this preferred embodiment of the paint tray liner 100 with attached an cover 1 is shown in FIGS. 1 through 18, inclusive, and FIG. 20, and reference is made thereto.

The paint tray liner 100 with an unattached cover 1 is similar to the embodiment of the paint tray liner 100 with an attached cover 1, except the hinge 18 is absent, thereby removing the connecting and attaching means between the liner body 2 and the liner cover 1, and there are two, rather than three modified embodiments utilizing the described alignment means. The first of these two modified embodiments utilizes the liner body 2 alignment tang 15 to matedly fit over the cover alignment tang 17, when the liner cover 1 is placed onto the liner body 2, thereby taking the paint tray liner 2 with an unattached cover 1 from the open position to the closed position. The second of said two modified embodiments additionally utilizes the cover inner radius 16 to matedly fit over the liner inner radius 14, when the liner cover 1 is placed onto the unattached cover 1, from the open position to the closed position.

Optionally, the liner body 2 can have one or more liner body tabs 28. Each liner body tab 28 is optionally perforated with a utility hole. In preferred embodiments, the paint tray liner body 2 has two liner body tabs 28, one protruding from the left side of the liner body 2 and one protruding from the right side. The liner body tabs 28 mate with liner cover tabs 29 on the liner cover 1. Both sets of tabs 28 and 29 are preferably slightly parted, slit and askew to allow the user to more easily open the paint tray liner 100 from the closed position. Tabs 29 and 30 can be manufactured with tab covers 30 and 31, respectively, which are perforated for easy removal by the user prior to first use.

The advantages of the present invention include:

1. The paint tray liner 100 with an attached cover 1 is a one-piece construction, and will therefore be less expensive to mold or form, and assemble for packaging and distribution.
2. The paint tray liner 100 with a cover 1 is designed to fit within a paint tray 19. A preferred embodiment of the paint tray liner 106 with a cover 1 will fit within a standard sized paint roller tray 19.
3. The paint tray liner 100 with an attached cover 1 is a one-piece construction, and will therefore be more convenient for the user, as the liner cover 1 is attached to the paint tray liner 100 and is readily available to cover the liner 100, when interrupting a paint job temporarily, thereby keeping the paint 27 relatively fresh. The use of the liner cover 1 during the interruption of a paint job further preserves the integrity of the paint 27 and the painting tools 25 and 26 contained therein by preventing dirt, dust and the like, from entering the paint tray liner 100.
4. The paint tray liner 100 with a cover 1 is designed to fit within a standard size paint tray 19, as shown in FIGS. 19 and 20; and, the liner cover 1 will close over said paint tray liner 100, even when the paint tray liner 100 is housed within a paint tray 24. See FIG. 20.

5. The paint tray liner 100 with an attached cover 1 is a one-piece construction and may close in a clam shell fashion, along the hinge 18 located along the width, and approximately in the middle of the length of the open paint tray liner 100, whereby the liner cover 1 may be shut and restrict the amount of fresh air in exposure to the paint surface, thereby inhibiting the hardening of the paint 27, and allowing the user to close the cover 1 over the paint tray liner 100 and return later to a tray 100 of relatively fresh paint 27 and painting tools, for a longer period of time, and e.g., the next day, if desired.

6. The paint tray liner 100 with a cover 1 may house painting tools, such as a paint brush 26 and a paint roller with handle 25 on the sloped platform 4, and with the handle of the brush 26 and the roller handle 25 protruding from, e.g., a rectangular opening 20 and a semicircular opening 19, respectively, and with the liner cover 1 in the closed position, so that the user may interrupt using the paint tray with a paint tray liner 100, and may return to use said paint tray 19 with the paint tray liner 100 the next day or later, if desired.

7. The paint tray liner 100 with an attached cover 1 is a one-piece construction whereby the interface between the liner body 2 and the liner cover 1 acts as the hinge 18, and said hinge 18 further acts as a preliminary alignment device, to align the liner body 2 with the liner cover 1; and in some embodiments with the alignment tangs 15 and 17, the hinge 18 may further align the liner body alignment tang 15 with the cover alignment tang 17 of the paint tray liner 100.

8. The paint tray liner 100 with a cover 1 may be composed essentially of a polymeric material, such as ABS, PETE and polypropylene, and in a preferred embodiment for use in retail displays with painting tools included therein, may be composed essentially of a transparent or translucent polymeric material. This transparent or translucent composition has advantages in packaging the paint tray liner 100 with a cover 1, for retail display, whereby paint tools, such as a paint brush 26 and paint roller with handle 25 may be housed within the paint tray liner 100 in the closed position.

Further objects, features and advantages of the present invention will be apparent to those of skill in the painting arts.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A combination comprising:

(a) a paint tray;

(b) a paint tray liner nested within the paint tray, the paint tray liner comprising:

(i) a liner body having a forward end, a rearward end, a bottom wall and side walls, the bottom wall being a sloped platform having a raised portion at the forward end of the liner body and a depressed paint well portion at the rearward end of the liner body, the side walls defining a perimeter around the paint tray liner;

(ii) an outer liner flange located around the perimeter of the liner body; and (iii) a cover connector attached to the liner body for connecting a cover to the paint tray liner;

wherein the paint tray liner is sized and dimensioned to substantially match the paint tray, so that the paint tray liner is nested within the paint tray; and (c) a cover for covering the liner body.

2. The combination of claim 1 wherein the liner body is non-metallic.

3. The combination of claim 1 wherein the cover connector comprises an upwardly directed tang disposed on the outer liner flange.

4. The combination of claim 1 wherein the cover connector comprises an upwardly directed tang disposed on the outer liner flange and the cover has a corresponding groove for receiving the tang.

5. The combination of claim 1 wherein the cover is attachable to the liner body by a snap fit.

6. The combination of claim 1 wherein the cover is reversibly connectable and disconnectable from the liner body.

7. The combination of claim 1 wherein the cover connector comprises a hinge and wherein the cover is attached to the liner body via the hinge.

8. The combination of claim 7 further comprising an upwardly directed tang disposed on the outer flange of the liner body.

9. The combination of claim 4 wherein the cover is elevated having sidewalls and a top wall, the top wall being elevated above the elevation of the outer flange of the liner body.

10. The combination of claim 9 wherein the top wall of the cover provides a cover indicia surface upon which is set forth a message.

11. The combination of claim 1 wherein the cover defines at least one cover opening so that, when the cover is disposed on the liner body, an elongate item of painting equipment disposed within the liner body can protrude rearwardly beyond the rearward end of the liner body through the at least one cover opening in the cover.

12. The combination of claim 11 wherein the cover defines at least two cover openings.

13. The combination of claim 1 wherein the liner body is made from a polymeric material.

14. The combination of claim 1 wherein the liner body is made from a polymeric material having graphite mixed therein.

15. The combination of claim 1 wherein the liner body is made from polyethylene terephalite.

16. The combination of claim 1 wherein the liner body has at least one rearwardly projecting liner body tab protruding from the outer flange and wherein the cover has at least one rearwardly protruding cover tab.

17. A combination comprising:

(a) a paint tray;

(b) a paint tray liner nested within the paint tray, the paint tray liner comprising:

(i) a liner body having a forward end, a rearward end, a bottom wall and side walls, the bottom wall being a sloped platform having a raised portion at the forward end of the liner body and a depressed paint well portion at the rearward end of the liner body, the side walls defining a perimeter around the paint tray liner;

(ii) an outer liner flange located around the perimeter of the liner body;

(iii) a cover for covering the liner body, the cover being elevated and having sidewalls and a top wall, the top wall being elevated above the elevation of the outer flange of the liner body, the cover defining at least one cover opening so that, when the cover is disposed on the liner body, an elongate item of painting equipment disposed within the liner body can protrude rearwardly beyond the rearward end of the liner body through the at least one cover opening in the cover; and (iv) a cover connector attached to the liner body for connecting a paint tray cover to the paint tray liner, the cover connector comprising an upwardly directed tang disposed on the outer liner flange, the tang being sized and dimensioned to mate with a corresponding groove in the cover, the cover being attachable to the liner body by a snap fit;

wherein the paint tray liner is sized and dimensioned to substantially match the paint tray, so that the paint tray liner is nested within the paint tray.

18. The combination of claim 17 wherein the cover is reversibly connectable and disconnectable from the liner body.

19. The combination of claim 17 wherein the cover connector comprises a hinge and wherein the cover is attached to the liner body via the hinge.

* * * * *